US010056678B2

(12) United States Patent
Nakamura

(10) Patent No.: US 10,056,678 B2
(45) Date of Patent: Aug. 21, 2018

(54) ANTENNA STRUCTURE AND METHOD FOR MANUFACTURING THE SAME, AND ELECTRONIC DEVICE

(71) Applicant: KYOCERA Corporation, Kyoto-shi, Kyoto (JP)

(72) Inventor: Kotaro Nakamura, Daito (JP)

(73) Assignee: KYOCERA Corporation, Kyoto (JP)

( * ) Notice: Subject to any disclaimer, the term of this patent is extended or adjusted under 35 U.S.C. 154(b) by 108 days.

(21) Appl. No.: 15/169,533

(22) Filed: May 31, 2016

(65) Prior Publication Data

US 2016/0276737 A1 Sep. 22, 2016

Related U.S. Application Data

(63) Continuation of application No. PCT/JP2015/082406, filed on Nov. 18, 2015.

(30) Foreign Application Priority Data

Nov. 26, 2014 (JP) ..... 2014-239148

(51) Int. Cl.
*H01Q 1/24* (2006.01)
*H01Q 1/50* (2006.01)

(52) U.S. Cl.
CPC ..... *H01Q 1/243* (2013.01); *H01Q 1/50* (2013.01)

(58) Field of Classification Search
CPC ..... H01Q 1/243; H01Q 1/244; H01Q 1/40; H01Q 9/091
USPC ..... 343/702, 873
See application file for complete search history.

(56) References Cited

U.S. PATENT DOCUMENTS 8,120,539 B2 * 2/2012 Hong ..... H01Q 1/1207 343/702
2005/0289401 A1 12/2005 Goin et al.
2009/0082075 A1 3/2009 Honda et al.
2010/0271283 A1 * 10/2010 Sung ..... B29C 45/14639 343/906
2014/0191910 A1 * 7/2014 Chung ..... H01Q 1/243 343/702

FOREIGN PATENT DOCUMENTS

JP 2009-081586 A 4/2009
JP 2013-239879 A 5/2012
JP 2014-155064 A 8/2014

OTHER PUBLICATIONS

International Search Report dated Dec. 28, 2015 issued by Japan Patent Office for International Application No. PCT/JP2015/082406.

(Continued)

*Primary Examiner* — Dameon E Levi
*Assistant Examiner* — Hasan Islam
(74) *Attorney, Agent, or Firm* — Procopio Cory Hargreaves and Savitch LLP

(57) ABSTRACT

An antenna structure includes a sheet metal antenna, a housing having an outer surface and an inner surface which face opposite to each other and having a through hole for inserting the sheet metal antenna from the outer surface to the inner surface, and a sealing portion which seals the through hole while relative positional relation between the sheet metal antenna and the rear-surface-side housing is fixed with the sheet metal antenna passing through the through hole.

8 Claims, 12 Drawing Sheets

(56) References Cited

OTHER PUBLICATIONS

Written Opinion of International Search Authority dated Dec. 28, 2015 issued by Japan Patent Office for International Application No. PCT/JP2015/082406.

* cited by examiner

ANTENNA STRUCTURE AND METHOD FOR MANUFACTURING THE SAME, AND ELECTRONIC DEVICE

CROSS-REFERENCE TO RELATED APPLICATION

The present application is a continuation based on PCT Application No. PCT/JP2015/082406 filed on Nov. 18, 2015, which claims the benefit of Japanese Application No. 2014-239148 filed on Nov. 26, 2014. PCT Application No. PCT/JP2015/082406 is entitled "Antenna Structure and Method for Manufacturing the Same, and Electronic Device", and Japanese Application No. 2014-239148 is entitled "Antenna Structure and Method for Manufacturing the Same, and Electronic Device". The content of which is incorporated by reference herein in their entirety.

FIELD

An embodiment in the present disclosure relates to an antenna structure and a method for manufacturing the same, as well as to an electronic device.

BACKGROUND

An electronic device may be required to be waterproof and to have ensured performance of communication through an antenna.

SUMMARY

An antenna structure based on the present disclosure includes a sheet metal antenna, a housing having an outer surface and an inner surface which face opposite to each other and having a through hole for inserting the sheet metal antenna from the outer surface to the inner surface, and a sealing portion which seals the through hole while relative positional relation between the sheet metal antenna and the housing is fixed with the sheet metal antenna passing through the through hole.

The foregoing and other objects, features, aspects and advantages of the present disclosure will become more apparent from the following detailed description of the present disclosure when taken in conjunction with the accompanying drawings.

DETAILED DESCRIPTION (First Embodiment)

An electronic device based on the present disclosure will be described with reference to FIG. 1. An electronic device 201 in the first embodiment includes an antenna structure based on the present disclosure. The "antenna structure based on the present disclosure" herein refers to an antenna structure described in any embodiment below. The antenna structure will be described later in detail.

Though description of electronic device 201 is given here with a smartphone being defined as the electronic device, the electronic device based on the present disclosure is not limited to the smartphone. The present disclosure is applicable to a wide variety of electronic devices.

Figure 1:
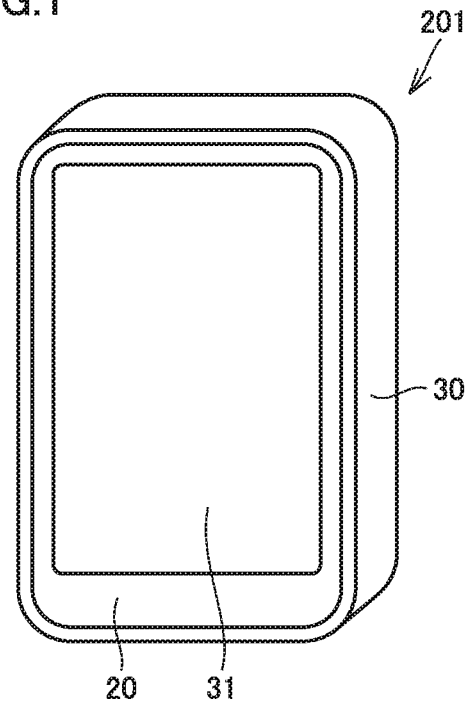
FIG. 1 is a perspective view of an electronic device in a first embodiment based on the present disclosure.

In an example shown in FIG. 1, electronic device 201 includes a display unit 31 in a front surface. Electronic device 201 includes an exterior cover 30 so as to substantially cover a rear surface and side surfaces. In the example shown in FIG. 1, a housing 20 is seen in a portion of electronic device 201 not covered with exterior cover 30. Though electronic device 201 includes exterior cover 30 here, it is merely by way of example and presence of exterior cover 30 in the electronic device based on the present disclosure is not essential.

Figure 2:
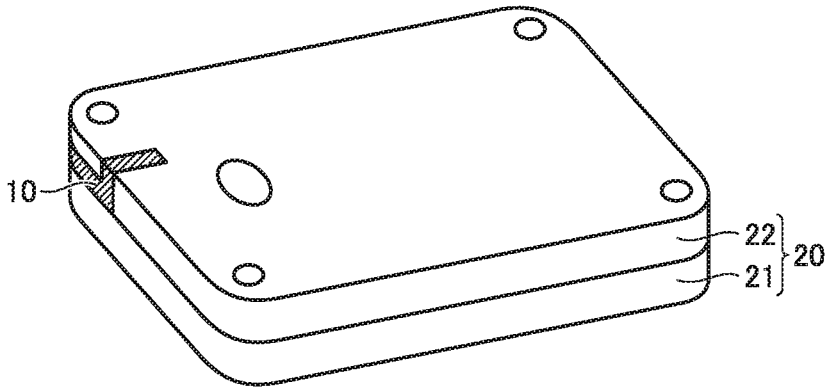
FIG. 2 is a perspective view of the electronic device from which an exterior cover has been removed in the first embodiment based on the present disclosure.

FIG. 2 shows a perspective view of a state that exterior cover 30 of electronic device 201 has been removed, with a side opposite to display unit 31, that is, a rear surface side, facing upward. Housing 20 includes a front-surface-side housing 21 and a rear-surface-side housing 22. A sheet metal antenna 10 is arranged to cover a part of an outer surface of rear-surface-side housing 22. Sheet metal antenna 10 is hidden while exterior cover 30 is attached to housing 20.

Figure 3:
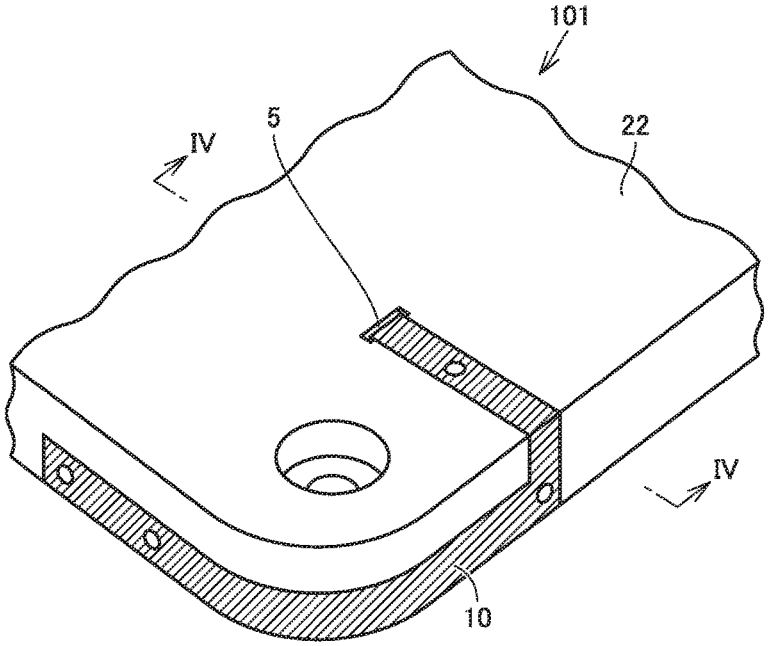
FIG. 3 is a partial perspective view of an antenna structure in a second embodiment based on the present disclosure.

Rear-surface-side housing 22 and sheet metal antenna 10 shown in FIG. 2 are some of components of the antenna structure based on the present disclosure. FIG. 3 shows an enlarged view of a part of a portion corresponding to the antenna structure based on the present disclosure, which is an extraction from the device shown in FIG. 2. FIG. 3 corresponds to an upper left portion in FIG. 2. FIG. 3 shows a view in a direction different from FIG. 2. A detailed structure of the antenna structure is as set forth in a second embodiment or later.

Since the first embodiment includes the antenna structure as described in embodiments which follow, a waterproof structure can readily be realized with a small number of parts. According to the first embodiment, a waterproof electronic device while it has a function to communicate through an antenna can be obtained.

(Second Embodiment)

Figure 4:
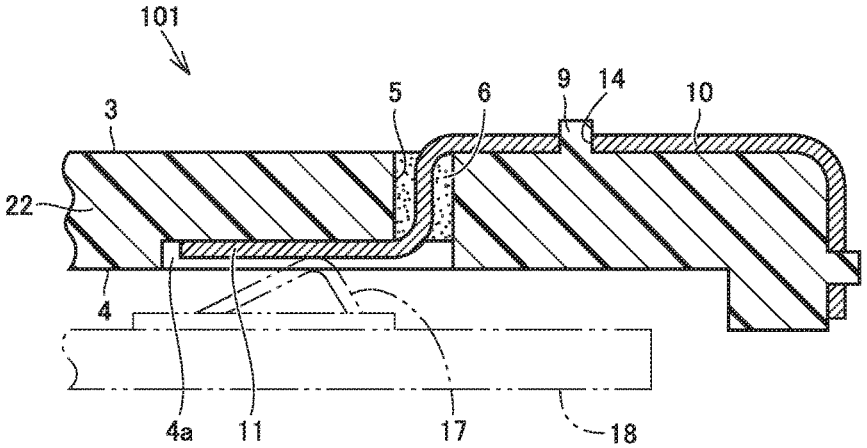
FIG. 4 is a cross-sectional view along the line IV-IV in FIG. 3.

The antenna structure in the second embodiment based on the present disclosure will be described with reference to FIGS. 3 to 7. FIG. 4 shows a cross-sectional view along the line IV-IV in FIG. 3.

An antenna structure 101 in the second embodiment includes sheet metal antenna 10, rear-surface-side housing 22 as a housing having an outer surface 3 and an inner surface 4 which face opposite to each other and having a through hole 5 for inserting sheet metal antenna 10 from outer surface 3 to inner surface 4, and a sealing portion 6 which seals through hole 5 while relative positional relation between sheet metal antenna 10 and rear-surface-side housing 22 as the housing is fixed with sheet metal antenna 10 passing through through hole 5.

Figure 5:
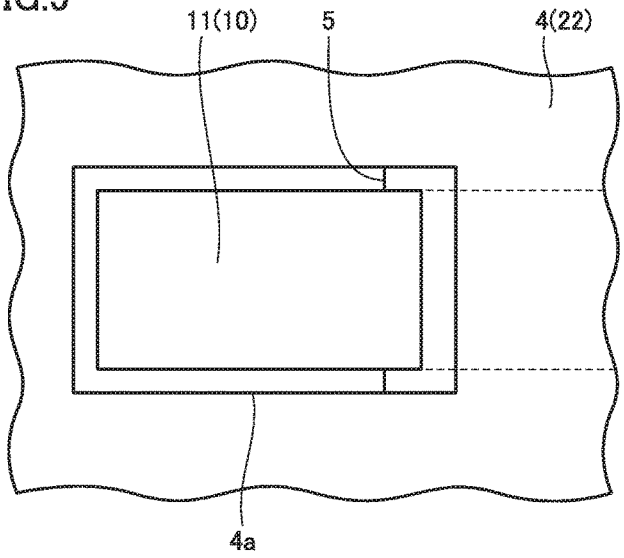
FIG. 5 is a partial bottom view of the antenna structure in the second embodiment based on the present disclosure.
Figure 6:
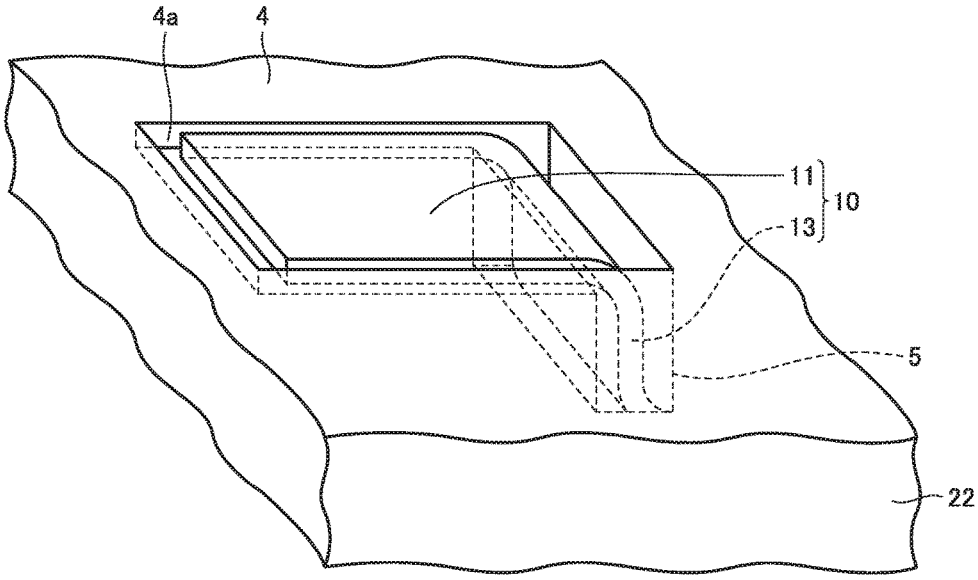
FIG. 6 is a partial perspective view of the antenna structure in the second embodiment based on the present disclosure.
Figure 7:
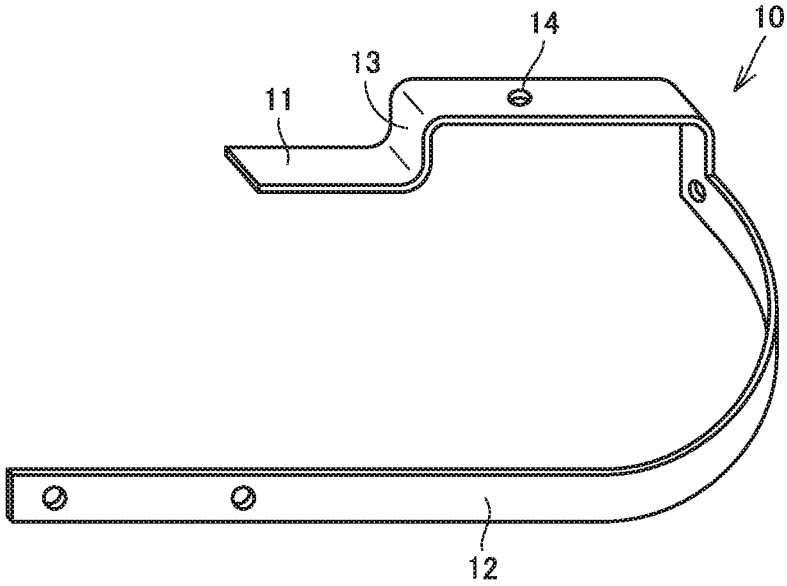
FIG. 7 is a perspective view of the sheet metal antenna included in the antenna structure in the second embodiment based on the present disclosure.

As shown in FIG. 4, an inner recess portion 4*a* is provided in inner surface 4 of rear-surface-side housing 22. Sheet metal antenna 10 includes an antenna terminal 11. Antenna terminal 11 is accommodated in inner recess portion 4*a*. A fixing hole 14 may be provided in sheet metal antenna 10. In this case, sheet metal antenna 10 is fixed to rear-surface-side housing 22 as a pin 9 provided on rear-surface-side housing 22 passes through fixing hole 14. FIG. 5 shows a portion in the vicinity of antenna terminal 11 in FIG. 4 viewed from below and FIG. 6 shows the same viewed from diagonally below. FIG. 7 shows sheet metal antenna 10 which has been extracted alone. Sheet metal antenna 10 is normally formed from an integrally formed metal piece in a form of a band. Sheet metal antenna 10 includes antenna terminal 11, an intermediate portion 13, and an antenna main body 12. Sheet metal antenna 10 normally has a structure as thus being bent midway.

FIGS. 5 and 6 show that antenna terminal 11 which has passed through through hole 5 in rear-surface-side housing 22 is accommodated in inner recess portion 4*a*. A spring contact terminal 17 placed on a wiring board 18 is relatively pressed against a surface of antenna terminal 11 as shown in FIG. 4, so that electrical connection is established. Though FIG. 4 shows wiring board 18 and spring contact terminal 17 with a chain double-dotted line, positions and shapes thereof are merely by way of example and not limited those as illustrated.

Since the through hole through which the sheet metal antenna passes is sealed with the sealing portion in the second embodiment, passage of water between the outside and the inside of the housing can be suppressed. Therefore, a waterproof structure of the housing can be realized while a state that performance of the sheet metal antenna can be exhibited is maintained. Since two parts of a nut with an O ring and a screw are not necessary in the second embodiment as compared with a method using a combination of a nut with an O ring and a screw, the number of parts can be reduced. A waterproof structure can readily be realized with a small number of parts.

Sealing portion 6 may include a filled portion filled with an adhesive. By adopting this feature, a sealing portion can readily be formed. Though the sealing portion may be formed by being partially filled with an adhesive, it may be formed by being totally filled with an adhesive.

The sealing portion may be formed with a method other than use of an adhesive. The sealing portion may be provided, for example, by filling a through hole with a resin and curing the resin. The sealing portion may achieve sealing by interposing a double-faced tape between the sheet metal antenna and the through hole. When the through hole is filled with a resin for forming the sealing portion, the resin may be cured or may remain in a gel state. When the sealing portion is provided by filling the through hole with a resin and curing the resin, a resin used here may include, for example, any of a thermosetting resin, a light curing resin, and a moisture curing resin.

As shown in FIG. 7, sheet metal antenna 10 may include antenna terminal 11 which extends along inner surface 4 for electrical connection to another component, antenna main body 12 which functions as the antenna while it is arranged along outer surface 3, and intermediate portion 13 which is interposed between antenna terminal 11 and antenna main body 12 and passes through through hole 5. With adoption of the sheet metal antenna thus including these portions, not only electrical connection to another component such as a wiring board but also transmission and reception as the antenna can be achieved simply by placing a single sheet metal antenna in the housing.

Though FIG. 7 shows sheet metal antenna 10 by way of example of the sheet metal antenna, a shape of the sheet metal antenna is not limited thereto. A length, a width, a manner of bending, a manner of branching, and arrangement of fixing hole 14 are not limited to those shown in FIG. 7. For example, a turn may be provided in a portion close to intermediate portion 13 which is opposite to antenna terminal 11 when viewed from intermediate portion 13, as in a sheet metal antenna 10*i* shown in FIG. 8. Two turns at a right angle are provided in the vicinity of a boundary between intermediate portion 13 and antenna main body 12. With such turns, a position of antenna terminal 11 is readily adjusted even while antenna main body 12 is fixed to the housing, and therefore an assembly operation is facilitated. The sheet metal antenna may be branched midway like a sheet metal antenna 10*j* shown in FIG. 9. As shown in FIG. 9, single sheet metal antenna 10*j* may have a plurality of antenna terminals. In the example shown here, sheet metal antenna 10*j* is branched so that it has intermediate portions 13*a* and 13*b* and has antenna terminals 11*a* and 11*b* at respective ends of intermediate portions 13*a* and 13*b*. Not only branch into two but also branch into three or more is applicable. Though not shown, a single sheet metal antenna may have a plurality of antenna main bodies as a result of being branched midway.

Figure 8:
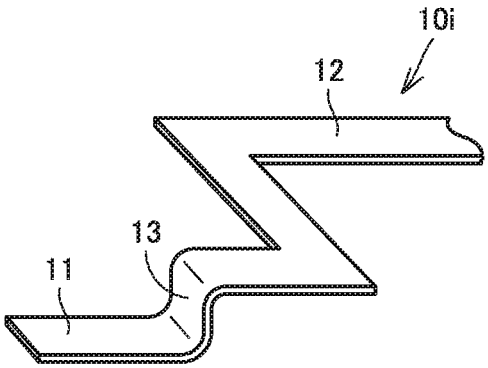
FIG. 8 is a partial perspective view of a first modification of the sheet metal antenna included in the antenna structure in the second embodiment based on the present disclosure.
Figure 9:
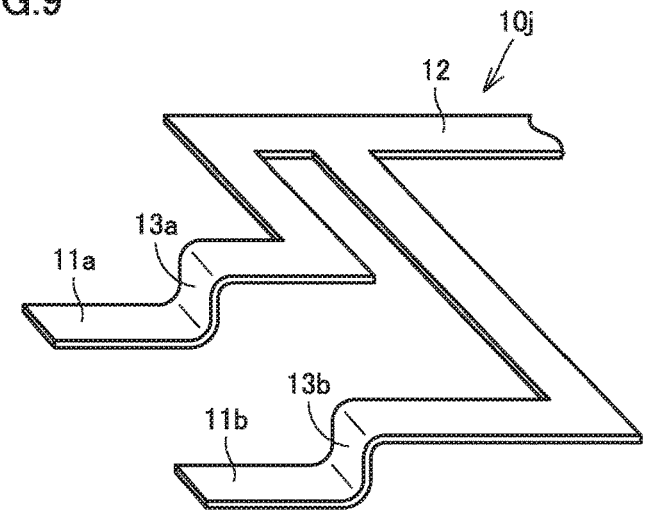
FIG. 9 is a partial perspective view of a second modification of the sheet metal antenna included in the antenna structure in the second embodiment based on the present disclosure.

Though FIGS. 8 and 9 do not show a fixing hole, a fixing hole may be provided as appropriate.

As shown in the second embodiment, rear-surface-side housing 22 may have inner recess portion 4*a* for accommodating antenna terminal 11 along inner surface 4. With this construction, antenna terminal 11 can reliably be arranged at a desired position. Since a position of antenna terminal 11 is substantially fixed while it is accommodated in inner recess portion 4*a*, inadvertent displacement of a position of antenna terminal 11 at the time when antenna terminal 11 is pressed against spring contact terminal 17 can be suppressed. As in the example shown in FIG. 4, a depth of inner recess portion 4*a* may be greater than a thickness of antenna terminal 11.

Figure 10:
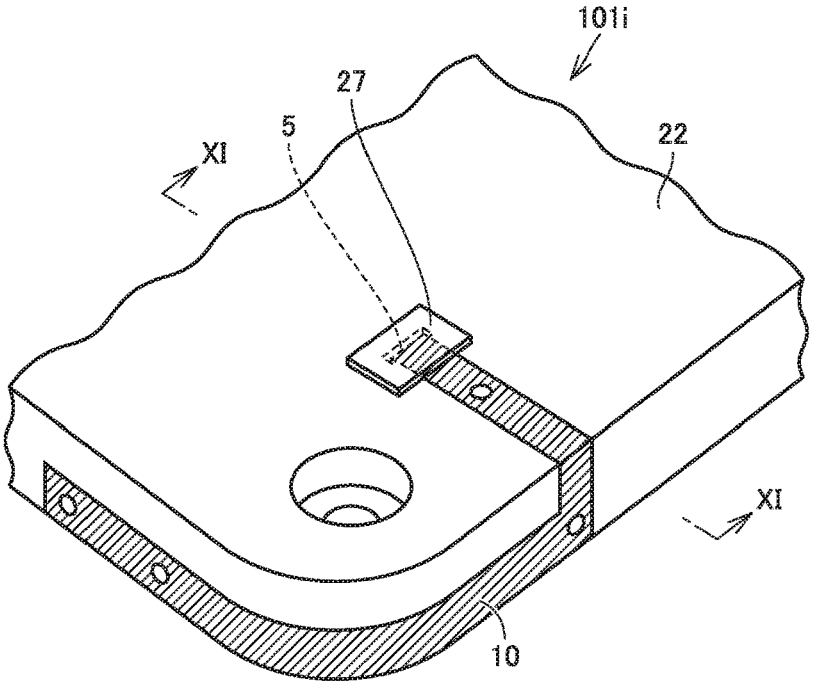
FIG. 10 is a partial perspective view of a first modification of the antenna structure in the second embodiment based on the present disclosure.
Figure 11:
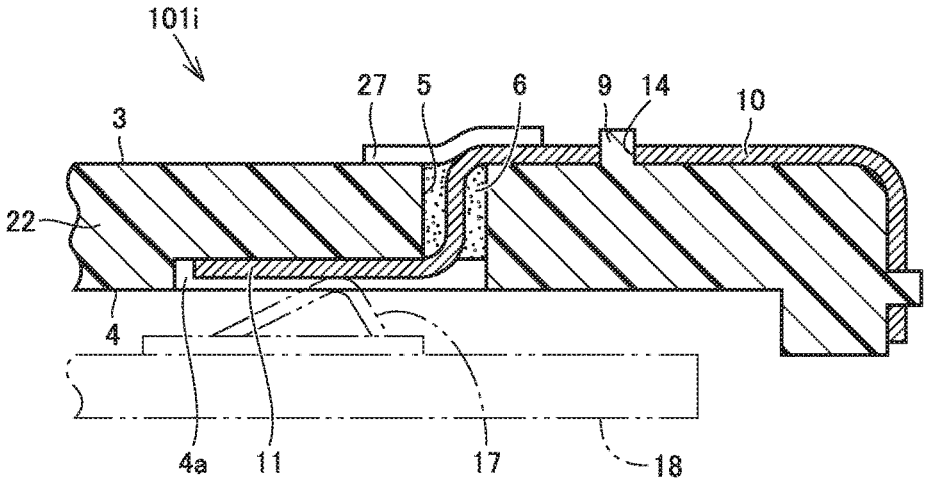
FIG. 11 is a cross-sectional view along the line XI-XI in FIG. 10.

A construction like an antenna structure 101*i* shown in FIG. 10 may be adopted. FIG. 11 shows a cross-sectional view along the line XI-XI in FIG. 10. In antenna structure 101*i*, a sheet 27 is stuck so as to close through hole 5. Sheet 27 is stuck astride outer surface 3 of rear-surface-side housing 22 and a surface of sheet metal antenna 10. Sticking of sheet 27 may be achieved, for example, by adhesion. Though a material for sheet 27 is not particularly limited, it may include, for example, polycarbonate. Sheet 27 has a thickness, for example, of 0.15 mm.

In assembly of antenna structure 101*i*, sheet metal antenna 10 is inserted in through hole 5 in rear-surface-side housing 22, thereafter sheet 27 is stuck so as to close an outer end of through hole 5, a surface having sheet 27 stuck is positioned to face downward in this state, and an adhesive 6 is injected through an opening portion of through hole 5 facing upward. Sheet 27 thus serves as a bottom and hence displacement or drop of adhesive 6 downward due to gravity is suppressed. Therefore, adhesive 6 is likely to stay at a desired position in through hole 5. It is thus easier to allow adhesive 6 to harden while adhesive 6 is arranged at an appropriate position. After adhesive 6 hardens, adhesive 6 is hidden by sheet 27 when rear-surface-side housing 22 is externally viewed, that is, from above in FIG. 11. Therefore, touch of adhesive 6 by a user can be suppressed. Sheet 27 plays a role to protect hardened adhesive 6.

Figure 12:
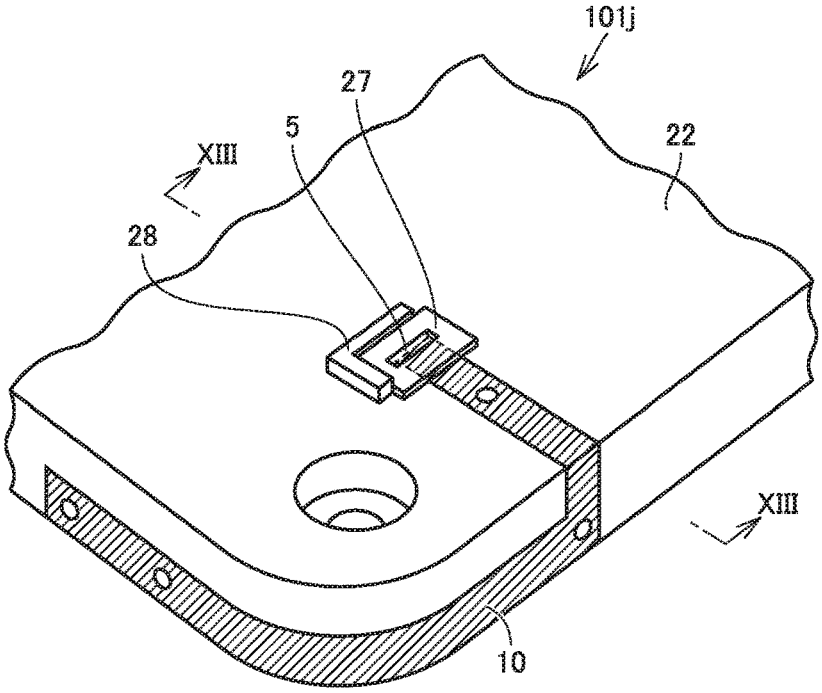
FIG. 12 is a partial perspective view of a second modification of the antenna structure in the second embodiment based on the present disclosure.
Figure 13:
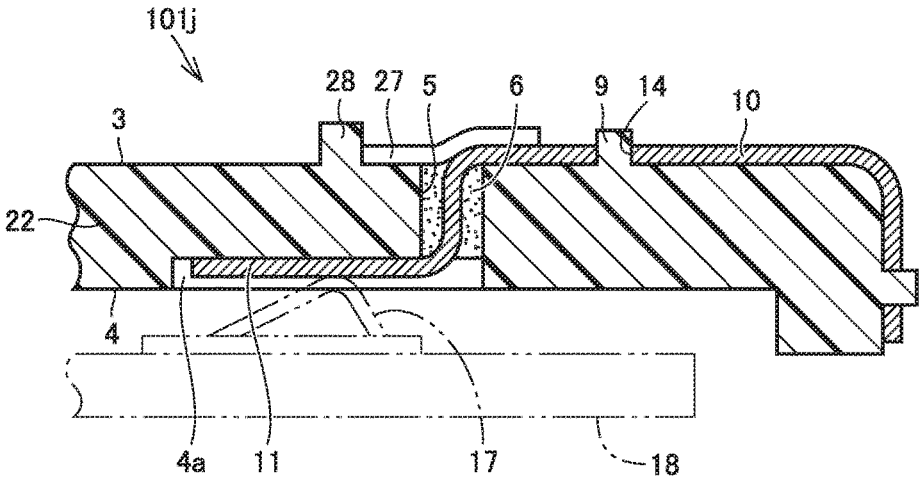
FIG. 13 is a cross-sectional view along the line XIII-XIII in FIG. 12.

Furthermore, a construction like an antenna structure 101*j* shown in FIG. 12 may be adopted. FIG. 13 shows a cross-sectional view along the line XIII-XIII in FIG. 12. In antenna structure 101*j*, a projection portion 28 for positioning of sheet 27 is provided in the vicinity of through hole 5. In the example shown in FIGS. 12 and 13, projection portion 28 is formed from a protrusion like a wall and it is in an L-shape when viewed two-dimensionally. In sticking sheet 27, sheet 27 is positioned by laterally pressing an end of sheet 27 against projection portion 28. Projection portion 28 is a part of rear-surface-side housing 22. Projection portion 28 may be formed integrally with other portions of rear-surface-side housing 22. Though an example in which projection portion 28 is in an L-shape has been shown here, the projection portion is not necessarily in an L-shape. Projection portion 28 is not limited to a projection portion in a shape of one continuous L, but two sides perpendicular to each other may be disposed at an interval from each other. Projection portion 28 may be formed, for example, from a plurality of protrusions in a form of pins. Sheet 27 may be positioned by laterally pressing sheet 27 against these protrusions in a form of pins.

Figure 14:
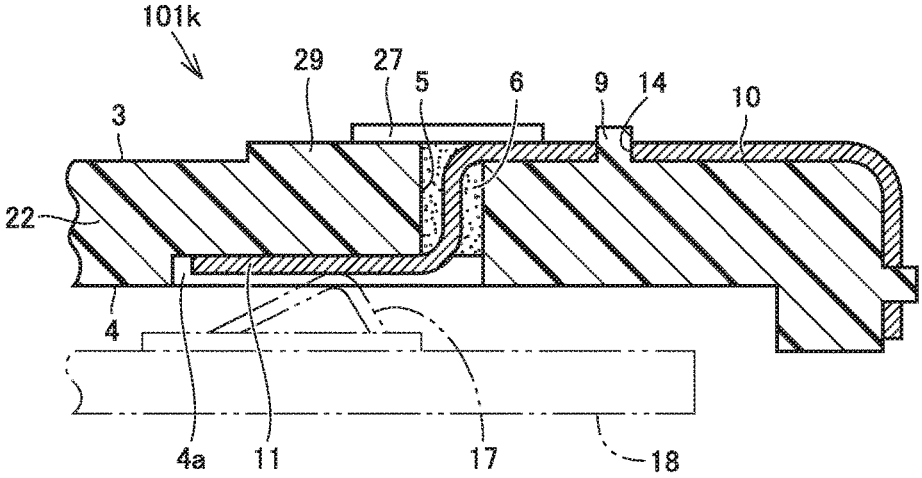
FIG. 14 is a partial perspective view of a third modification of the antenna structure in the second embodiment based on the present disclosure.

Though a height difference has been provided midway in sheet 27 in the example shown in FIGS. 11 and 13, such a height difference does not have to be provided. For example, a construction like an antenna structure 101*k* shown in FIG. 14 may be adopted. A shored-up portion 29 is provided in a part in the vicinity of through hole 5 in an upper surface 3 of rear-surface-side housing 22. Shored-up portion 29 refers to a portion increased in height like a platform. An upper surface of shored-up portion 29 is flat. In the example shown in FIG. 14, a height of shored-up portion 29 is substantially the same as a thickness of sheet metal antenna 10. By adopting this construction, sheet 27 can be stuck while sheet 27 is not substantially bent but maintains a flat state. Since load applied to sheet 27 can be lower by sticking the sheet in such a flat state, reliability of sheet 27 increases. Shored-up portion 29 should only be provided in a region around through hole 5 where sheet 27 is layered. Though projection portion 28 is not shown in the example shown in FIG. 14, projection portion 28 and shored-up portion 29 may both be provided. For example, on an upper surface of shored-up portion 29, a projection portion 29 for positioning may be provided to further protrude.

(Third Embodiment)

Figure 15:
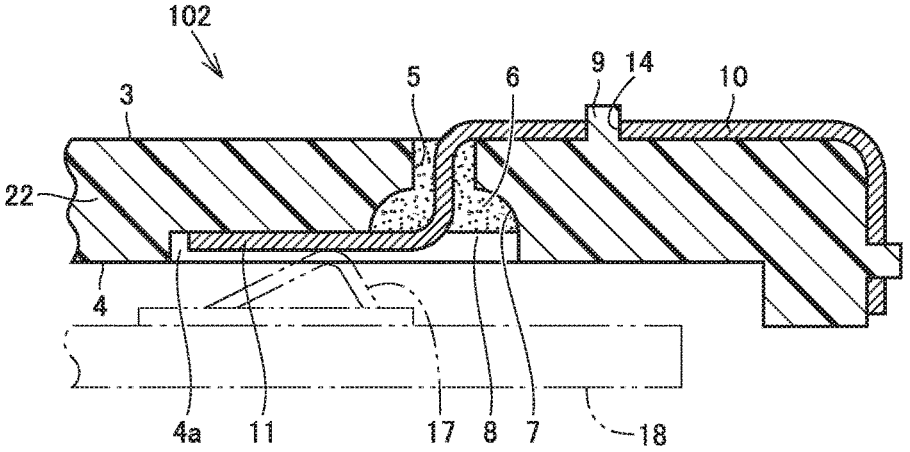
FIG. 15 is a partial cross-sectional view of an antenna structure in a third embodiment based on the present disclosure.

An antenna structure in a third embodiment based on the present disclosure will be described with reference to FIGS. 15 to 17. Though an antenna structure 102 in the third embodiment is similar in basic construction to antenna structure 101 described in the second embodiment, it is different in the following points. In antenna structure 102, rear-surface-side housing 22 as the housing has a space for adhesive 7 adjacent to through hole 5, and sealing portion 6 includes a cured portion in which an adhesive is cured in space for adhesive 7.

Space for adhesive 7 is not limited to a space completely partitioned as one chamber, and it should only be a space in which an adhesive can be pooled to some extent. Space for adhesive 7 may be called an adhesive pool.

Figure 16:
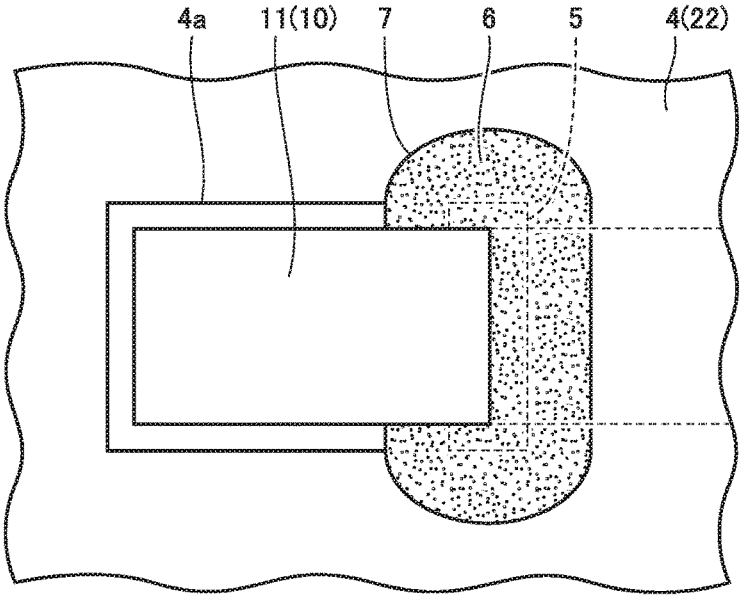
FIG. 16 is a partially enlarged bottom view of a portion in the vicinity of an antenna terminal of the antenna structure in the third embodiment based on the present disclosure.
Figure 17:
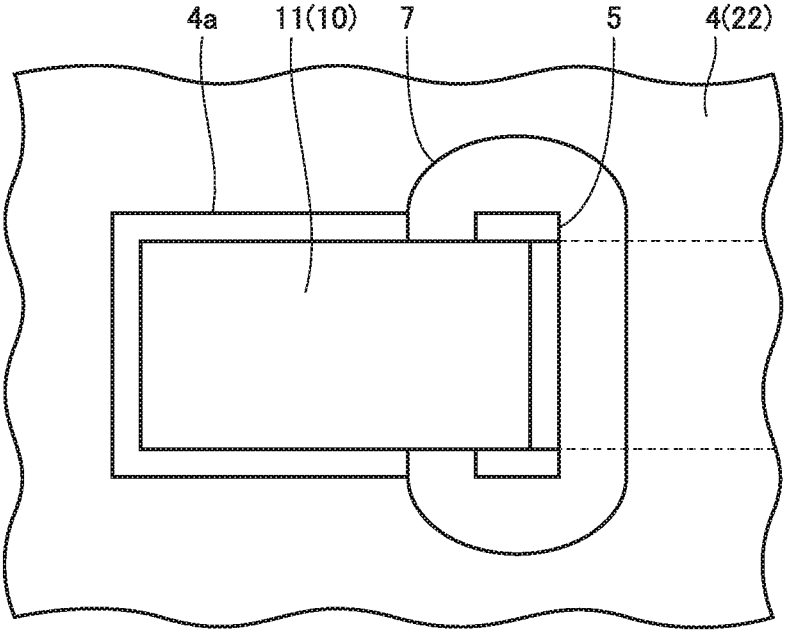
FIG. 17 is a partially enlarged bottom view of the portion in the vicinity of the antenna terminal of the antenna structure before an adhesive is injected in the third embodiment based on the present disclosure.

FIG. 16 shows a portion in the vicinity of antenna terminal 11 in FIG. 15 when viewed from below. FIG. 17 shows a state before an adhesive is injected into space for adhesive 7. In this example, space for adhesive 7 is provided as a substantially elliptical recess portion.

As shown in the third embodiment, with space for adhesive 7, a certain amount of adhesive can be pooled in space for adhesive 7 in a stable manner in supply of an adhesive before curing for sealing, and hence reliable sealing is facilitated.

An inlet of the space for adhesive may be provided on any side of the housing. In the example shown in FIG. 15, space for adhesive 7 widely opens into inner surface 4, however, it may widely open into outer surface 3 to the contrary. For better appearance of the housing or for avoidance of the possibility of degradation of an adhesive due to contact with water as much as possible, an area of a region on outer surface 3 where an adhesive is exposed is desirably minimized Therefore, space for adhesive 7 may have an adhesive inlet 8 which opens into inner surface 4.

(Fourth Embodiment)

Figure 18:
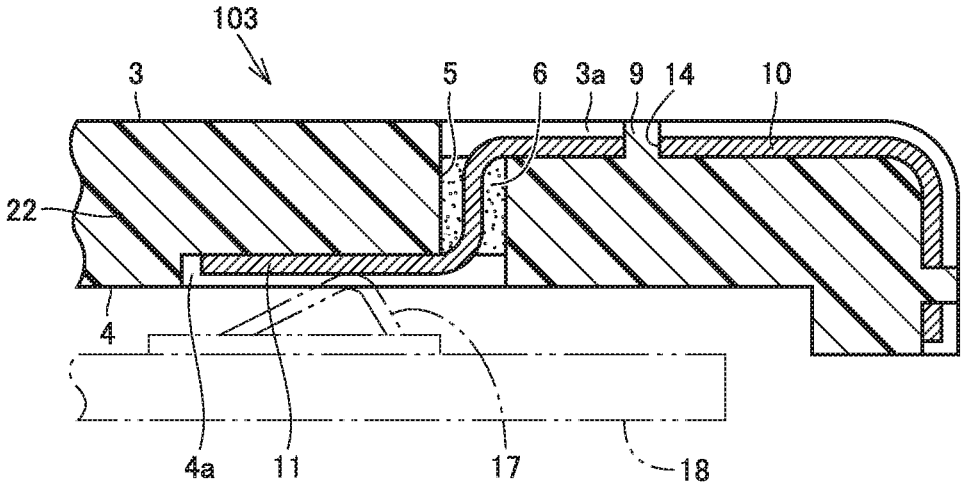
FIG. 18 is a partial cross-sectional view of an antenna structure in a fourth embodiment based on the present disclosure.
Figure 19:
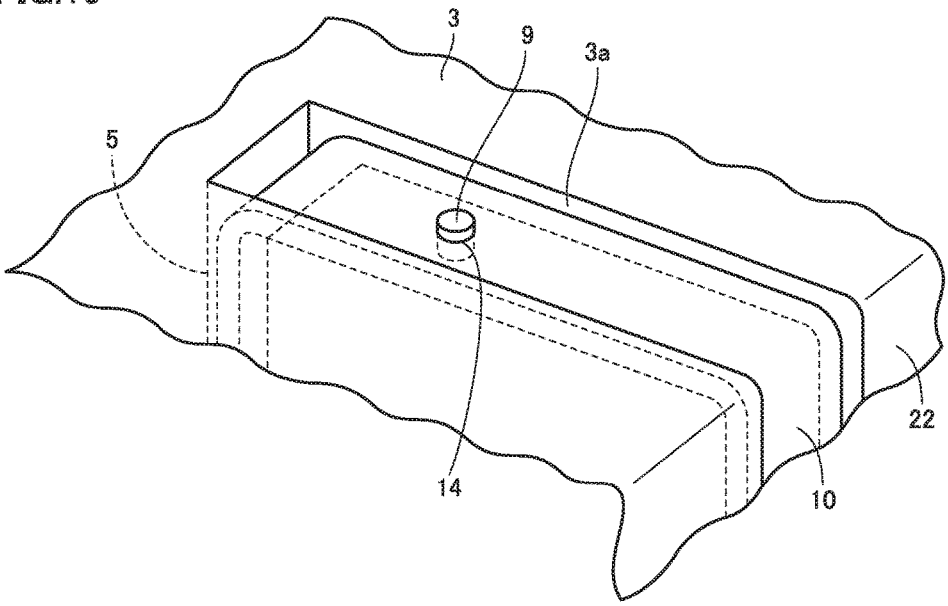
FIG. 19 is a partial perspective view of a portion in the vicinity of a through hole in the antenna structure in the fourth embodiment based on the present disclosure.

An antenna structure in a fourth embodiment based on the present disclosure will be described with reference to FIGS. 18 to 19. Though an antenna structure 103 in the fourth embodiment is similar in basic construction to antenna structure 101 described in the second embodiment, it is different in the following points.

Rear-surface-side housing 22 has an outer recess portion 3*a* for accommodating antenna main body 12 along outer surface 3. FIG. 19 shows a portion in the vicinity of through hole 5 in FIG. 18 when viewed diagonally above.

Since outer recess portion 3*a* is provided in outer surface 3 in the fourth embodiment, antenna main body 12 can easily be fixed to a desired position. As antenna main body 12 is accommodated in such a recess portion in outer surface 3, protrusion of antenna main body 12 outward from the housing can be avoided. As shown in the fourth embodiment, a depth of outer recess portion 3*a* may be greater than a thickness of sheet metal antenna 10.

Sheet 27 described in the second embodiment may be employed in the fourth embodiment. In this case, sheet 27 is stuck astride outer surface 3 of rear-surface-side housing 22 and the upper surface of sheet metal antenna 10 in outer recess portion 3*a*. In order not to produce a height difference in stuck sheet 27, a depth of outer recess portion 3*a* should only be substantially the same as a thickness of sheet metal antenna 10.

In the fourth embodiment, projection portion 28 for positioning as described in the second embodiment may be provided on outer surface 3 of rear-surface-side housing 22. By thus providing projection portion 28 for positioning, an operation to stick sheet 27 is facilitated.

(Fifth Embodiment)

Figure 20:
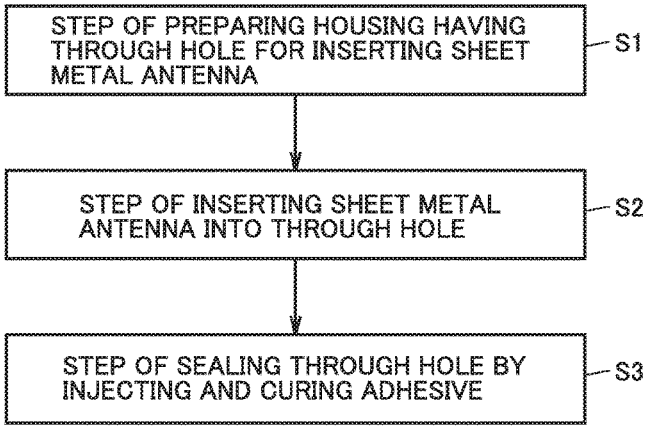
FIG. 20 is a flowchart of a method for manufacturing an antenna structure in a fifth embodiment based on the present disclosure.

A method for manufacturing an antenna structure in a fifth embodiment based on the present disclosure will be described with reference to FIGS. 20 to 23. FIG. 20 shows a flowchart of the method for manufacturing an antenna structure in the fifth embodiment. The method for manufacturing an antenna structure in the fifth embodiment includes a step S1 of preparing a housing having an outer surface and an inner surface which face opposite to each other and having a through hole for inserting a sheet metal antenna from the outer surface to the inner surface, a step S2 of inserting the sheet metal antenna into the through hole, and a step S3 of sealing the through hole while the sheet metal antenna and the housing are fixed relative to each other by injecting and curing an adhesive in a portion including the through hole after the inserting step S2.

Each step will be described below in detail.

Figure 21:
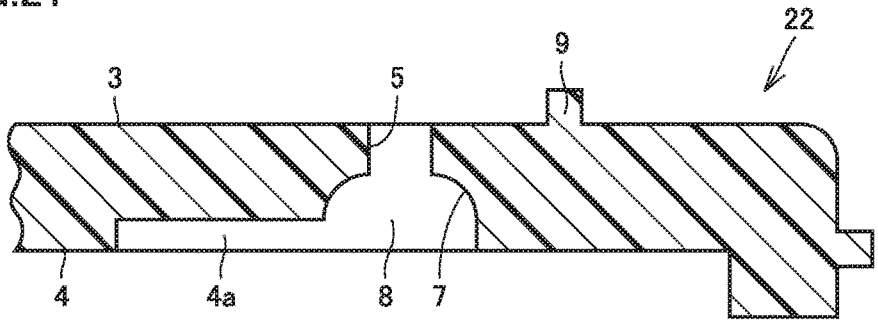
FIG. 21 is a diagram illustrating a first step in the method for manufacturing an antenna structure in the fifth embodiment based on the present disclosure.

In the step S1, a housing is prepared. FIG. 21 shows a cross-section of one example of the housing. This housing is represented as rear-surface-side housing 22 already disclosed in the third embodiment. Rear-surface-side housing 22 has outer surface 3 and inner surface 4 which face opposite to each other. Rear-surface-side housing 22 has through hole 5 for inserting sheet metal antenna 10 from outer surface 3 to inner surface 4. Rear-surface-side housing 22 may include pin 9 for fixing sheet metal antenna 10.

Figure 22:
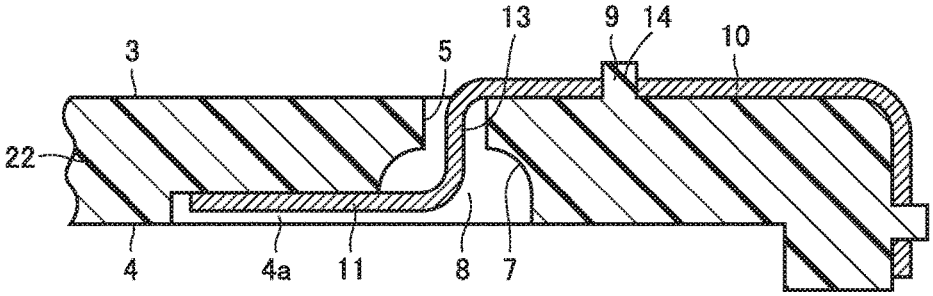
FIG. 22 is a diagram illustrating a second step in the method for manufacturing an antenna structure in the fifth embodiment based on the present disclosure.

In the step S2, as shown in FIG. 22, sheet metal antenna 10 is inserted in through hole 5. Sheet metal antenna 10 may be, for example, as shown in FIG. 7. Intermediate portion 13 of sheet metal antenna 10 is arranged to pass through through hole 5 and antenna terminal 11 is arranged to be accommodated in inner recess portion 4*a* provided in inner surface 4. Sheet metal antenna 10 is fixed to rear-surface-side housing 22 by inserting pin 9 into fixing hole 14 provided in advance in sheet metal antenna 10.

Figure 23:
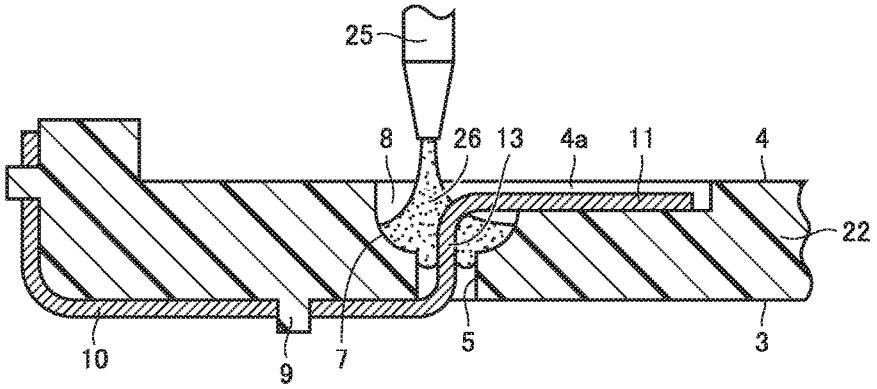
FIG. 23 is a diagram illustrating a third step in the method for manufacturing an antenna structure in the fifth embodiment based on the present disclosure.

In the step S3, as shown in FIG. 23, an adhesive 26 is injected and cured in a portion including through hole 5. Through hole 5 is thus sealed while sheet metal antenna 10 and rear-surface-side housing 22 as the housing are fixed relative to each other. In the example shown in FIG. 23, a dispenser 25 arranged above supplies adhesive 26 while rear-surface-side housing 22 is positioned such that adhesive inlet 8 of space for adhesive 7 faces upward. By injecting and curing adhesive 26 as shown in FIG. 23, antenna structure 102 as shown in FIG. 15 is obtained.

In the fifth embodiment, an antenna structure having a waterproof structure can easily be obtained with a small number of parts and without a complicated step.

Though manufacturing of antenna structure 102 has been described here by way of example, another antenna structure can also similarly be manufactured by modifying as appropriate a structure of rear-surface-side housing 22 prepared in the step S1.

Though description has been given in each embodiment on the premise that rear-surface-side housing 22 is adopted as a housing included in an antenna structure, limitation thereto is not intended. The housing included in the antenna structure may be of another type.

A plurality of antenna structures may be constructed in a single housing.

Though the antenna structure described so far is assumed to be provided mainly in an electronic device, such an electronic device is as described already in the first embodiment. A single electronic device may include a plurality of antenna structures. In this case, a plurality of antenna structures different in structure may exist together in a single electronic device.

Some of embodiments may be adopted as being combined as appropriate.

Embodiments disclosed herein are illustrative and non-restrictive in every respect. The scope of the present disclosure is defined by the terms of the claims and includes any modifications within the scope and meaning equivalent to the terms of the claims.

Some of embodiments may be adopted as being combined as appropriate.

Though embodiments of the present disclosure have been described, it should be understood that embodiments disclosed herein are illustrative and non-restrictive in every respect. The scope of the present disclosure is defined by the terms of the claims and is intended to include any modifications within the scope and meaning equivalent to the terms of the claims.

The invention claimed is:

1. An antenna structure comprising:

a sheet metal antenna;

a housing having an outer surface and an inner surface which face opposite to each other and having a through hole for inserting the sheet metal antenna from the outer surface to the inner surface;

the sheet metal antenna including an antenna terminal extending along the inner surface of the housing for electrical connection to another component, an antenna main body arranged along the outer surface of the housing and functioning as an antenna, and an intermediate portion which is interposed between the antenna terminal and the antenna main body and passes through the through hole; and a sealing portion which seals the through hole while relative positional relation between the sheet metal antenna and the housing is fixed with the intermediate portion of the sheet metal antenna passing through the through hole.

2. The antenna structure according to claim 1, wherein the sealing portion includes a filled portion filled with an adhesive.

3. The antenna structure according to claim 1, wherein the housing has an inner recess portion for accommodating the antenna terminal along the inner surface.

4. The antenna structure according to claim 1, wherein the housing has an outer recess portion for accommodating the antenna main body along the outer surface.

5. An electronic device comprising the antenna structure according to claim 1.

6. An antenna structure comprising:

a sheet metal antenna;

a housing having an outer surface and an inner surface which face opposite to each other and having a through hole for inserting the sheet metal antenna from the outer surface to the inner surface; and a sealing portion which includes a fill portion filled with an adhesive which seals the through hole while relative positional relation between the sheet metal antenna and the housing is fixed with the sheet metal antenna passing through the through hole;

wherein the housing has a space for adhesive adjacent to the through hole and the sealing portion includes a cured portion in which the adhesive has been cured in the space for adhesive.

7. The antenna structure according to claim 6, wherein the space for adhesive has an adhesive inlet which opens into the inner surface.

8. A method for manufacturing an antenna structure, the method comprising:

preparing a housing having an outer surface and an inner surface which face opposite to each other and having a through hole for inserting a sheet metal antenna from the outer surface to the inner surface, the sheet metal antenna having an antenna terminal, an antenna main body, and an intermediate portion between the antenna terminal and antenna main body;

inserting the sheet metal antenna into the through hole with the antenna terminal extending along the inner surface for electrical connection to another component, the intermediate portion passing through the through hole, and the antenna main body arranged along the outer surface and functioning as an antenna; and sealing the through hole while the sheet metal antenna and the housing are fixed relative to each other by injecting and curing an adhesive in a portion including the through hole, after the inserting.

* * * * *